US007037020B2

(12) United States Patent
Neuendorf

(10) Patent No.: US 7,037,020 B2
(45) Date of Patent: May 2, 2006

(54) DEVICE FOR MOISTENING TOILET PAPER

(76) Inventor: Ronald Neuendorf, Pommerhweg 20, 71720 Oberstenfeld (DE)

( * ) Notice: Subject to any disclaimer, the term of this patent is extended or adjusted under 35 U.S.C. 154(b) by 43 days.

(21) Appl. No.: 10/296,776

(22) PCT Filed: May 15, 2001

(86) PCT No.: PCT/DE01/01843

§ 371 (c)(1),
(2), (4) Date: Nov. 26, 2002

(87) PCT Pub. No.: WO01/89353

PCT Pub. Date: Nov. 29, 2001

(65) Prior Publication Data

US 2003/0132314 A1 Jul. 17, 2003

(30) Foreign Application Priority Data

May 26, 2000 (DE) ..... 100 26 118

(51) Int. Cl.
*B43K 1/06* (2006.01)
*A47L 13/30* (2006.01)
*A46B 5/02* (2006.01)

(52) U.S. Cl. ..... 401/265; 401/263; 401/190

(58) Field of Classification Search ..... 401/118, 401/190, 199, 203, 204, 205, 263, 264, 265; 222/402.13, 205, 182, 183, 383.1
See application file for complete search history.

(56) References Cited

U.S. PATENT DOCUMENTS

| | | | | |
|---|---|---|---|---|
| 2,774,517 | A * | 12/1956 | Teegardin et al. | 222/385 X |
| 4,087,022 | A * | 5/1978 | Zanetti-Streccia | 222/183 |
| 4,226,340 | A * | 10/1980 | Troesch | 222/183 |
| 5,465,873 | A * | 11/1995 | Mejean et al. | 222/383.1 X |

FOREIGN PATENT DOCUMENTS

| | | | |
|---|---|---|---|
| CH | 368 590 | | 5/1963 |
| DE | 173546 | | 7/1906 |
| DE | 29 12 972 | | 10/1980 |
| DE | 3601591 | C1 * | 7/1987 |
| DE | 89 03 900 | | 6/1989 |
| DE | 3690809 | T1 | 12/1989 |
| DE | 91 12 823 | | 1/1992 |
| DE | 297 16 687 | | 1/1998 |
| WO | 99/53816 | | 10/1999 |

* cited by examiner

*Primary Examiner*—David J. Walczak
(74) *Attorney, Agent, or Firm*—Darby & Darby

(57) ABSTRACT

A device for moistening fluid-absorbing media for body-hygiene or care, such as toilet paper, cotton balls, cleaning tissues, cotton pads, and fleece, includes a system reservoir for storing fluid for moistening the media and a stroke valve unit attached to the system reservoir, which gives off liquid or a liquid mist by its nozzle. A detachable distribution unit is attached to the valve unit and includes a distribution plate or funnel unit with a capillary unit. The nozzle is positioned in a recess in the bottom of the distribution plate or funnel unit. The fluid-absorbing media is placed on the capillary unit to initiate a stroke movement of the valve unit, whereby the liquid or liquid mist released through the stroke movement is at least partially taken up by the distribution unit through a capillary effect. The liquid or liquid mist then passes from the distribution unit to the fluid-absorbing media via the "blotting-paper" principle.

9 Claims, 9 Drawing Sheets

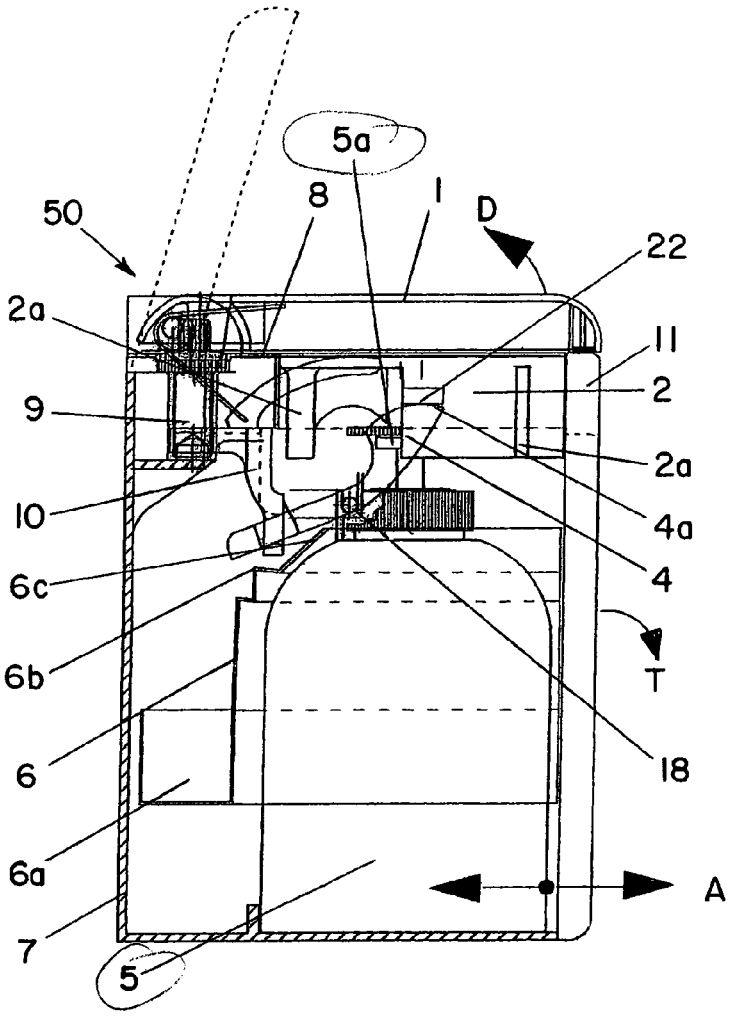
FIG. 4a
FIG. 4b
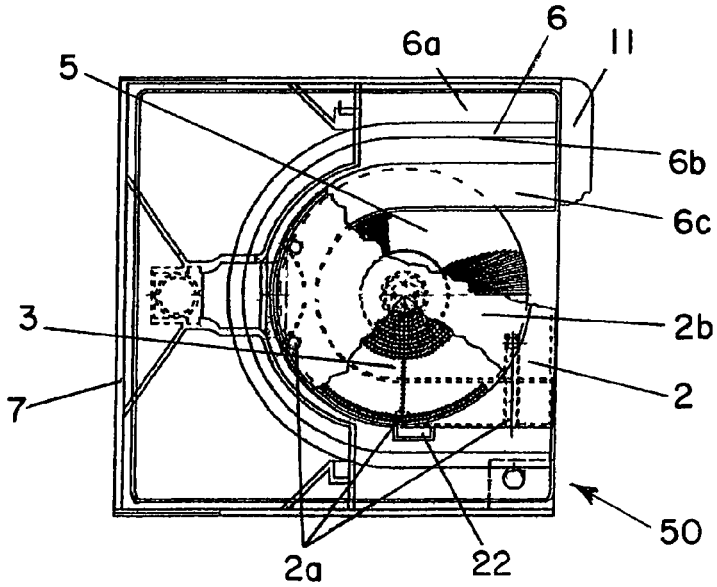

DEVICE FOR MOISTENING TOILET PAPER

CROSS-REFERENCE TO RELATED APPLICATION

This is a U.S. national phase application under 35 U.S.C. §371 of International Patent Application No. PCT/DE01/01843, filed May 15, 2001, which is incorporated herein by reference in its entirety.

FIELD OF THE INVENTION

The present invention relates to a device for moistening fluid-absorbing media for body-hygiene or care, such as toilet paper, cotton balls, cleaning tissues, cotton pads, fleeces and similar, with a system reservoir, in which the fluid for moistening is stored, and a stroke valve unit attached to the system reservoir, which upon engagement gives off liquid or a liquid mist by way of its nozzle.

The cleaning of the anus after bowel movement solely with dry toilet paper is insufficient and unsatisfactory according to hygiene standards, and often results in feelings of discomfort and insecurity. No one would even think of cleaning their hands or face, when comparably dirty, solely with dry paper.

DESCRIPTION OF THE RELATED ART

To meet the challenges of an increased level of hygiene, the use of pre-moistened toilet tissues is known. However, these have a number of disadvantages.

Pre-moistened toilet tissues are available, folded and stacked in a box. Upon removing from the box, a single piece must be separated from the rest, which can be very difficult and often requires the use of both hands. Closing the box after use can also be difficult, but is another necessary action, since otherwise the pre-moistened toilet tissues would dry out very quickly.

A very decisive disadvantage of the pre-moistened toilet tissues is that they dissolve very poorly and slowly in liquid, including the sewage, which can easily be the cause of clogged pipes. This resistance to moisture and liquid proves very difficult in the further ecological chain and necessitates additional treatment in sewage processing and generally when diverting sewage water back into rivers.

Furthermore, there are different solutions known, that have dealt with the idea to moisten normal toilet paper.

Several solutions moisten the normal toilet paper, as the strips of individual pieces come off the roll, through contact to a wet fleece that previously had been pulled through cleansing liquid in an open container. This means that the moistened toilet paper must be pulled out of the device with a certain force, in order to unwind the supply roll. Such a solution is described in the example WO 99/53816. The result is that the toilet paper strip begins to dissolve due to the moisture, which prohibits it being mechanically strained, thereby frequently ripping unintentionally. Repeated, complicated and time consuming threading of the strip of paper in the device becomes necessary. Often it is very complicated to refill the liquid into such devices, increasing the danger of spilling. Furthermore, due to the open container it is possible that the liquid can be contaminated.

Other solutions spray liquid onto normal toilet paper, in order to reach this moistening effect. For example from the German sample pattern device G 89 03 900 it is known to use a flexible reservoir that is pressed together, and through the volume reduction the stored cleansing liquid is pressed through a nozzle and sprayed onto the paper. Such a solution does not do justice to the different types of paper and differing structures of toilet paper, since the dispersed amounts are determined only by feeling and not exactly by predetermined dosage. Another disadvantage is that the container when returning to its form fills with air, which must first escape before repeating the procedure of dispersing liquid.

From the German sample pattern device G 91 12 823 a liquid dispenser for toilet paper is known, through which the liquid is transported from the reservoir onto the normal toilet paper by way of a roller-ball body which is part of a valve. This is also very imprecise as far as the liquid dosage to be transported onto the paper is concerned, since the transfer position is blocked from view. Furthermore, the liquid transfer takes considerable time, if the paper is to be moistened sufficiently. The commonly used valves normally have the disadvantage that after a short time, they do not close tightly(seal), since particles enter the valve by way of the roller-ball. Due to leakage the moistening liquid escapes and leads to soiling the environment.

Besides toilet paper there are other fluid absorbing media used in personal hygiene such as cotton balls, cleansing cloths or similar items. Often there are cleansing liquids in the sanitary area in bottles or other containers to be used for personal hygiene. In order to bring the liquid onto the carriers for cleaning, the bottles must be opened, contact made with the carrier, turned and then closed and put away.

SUMMARY OF THE INVENTION

From the initial position of the above mentioned status of technology, this invention has resulted from the task or the technical challenges to develop a device for moistening fluid-absorbing media which satisfies hygiene standards, guarantees a simple operation, as well as a continuous reliable function in regards to the moistening and operation, and that can be used economically.

The invented device for moistening fluid-absorbing media is given through the features of the independent claim 1. Advantageous arrangements and extensions are objects of dependent claims.

The invented device distinguishes itself, therefore, that on the valve unit, a detachable distribution unit is attached to its stroke movement, which includes a distribution plate with a capillary unit on it, or a funnel unit with a capillary unit on it, in the bottom of the distribution plate/funnel unit there is a hole in which the nozzle of the valve unit is positioned, the media to be moistened can be placed on the capillary unit to initiate the stroke movement, whereby the capillary unit is so designed and dimensioned so that the liquid/liquid mist released through the stroke movement will be at least partially taken up through the capillary effect and this liquid/liquid mist passed on to the fluid-absorbing media via the "blotting-paper" principle.

A very preferred extension is distinguished by the holes in the moistening screen or the mesh unit being positioned and dimensioned so that through the capillary function the liquid or liquid mist transported into the space between distribution plate and moistening screen, or funnel unit by the stroke movement is in place, and the "blotting-paper" effect occurs on the liquid-absorbing media placed on it.

A very preferred arrangement is distinguished by the capillary unit being specifically distanced from the distribution plate and is designed as moistening screen or mesh unit with through holes.

As an alternative the capillary unit can be designed as a sponge.

The invented device offers the advantage of moistening toilet paper comfortably and with perfect hygiene with one hand, whereby, the amount of cleansing liquid can be preset on the device, depending on quality and structure of the toilet paper. By simply laying the fluid-absorbing media on the capillary unit, respectively the moistening screen and simply executing the stroke movement the media is moistened at the preset measure.

To insure a reliable distribution of the liquid in the space, a very preferred arrangement of the invented device distinguishes itself that the moistening screen or the mesh unit forms a rebounding surface on the bottom being across the area from the nozzle of the valve unit.

Preferably there is at least one runoff on the distribution plate/funnel unit, for the excessive liquid to runoff, so that if the volume of the entering liquid is first set too high, it would not lead to an overdoses of moistening of the toilet paper for example.

A very preferred arrangement is distinguished by the distribution unit with the system reservoir is positioned detachably in a housing. With this measure it becomes possible to use a refill system, which means the housing and the distribution unit remain and only the system reservoir is replaced.

A simple operating distinguishes itself according to a preferred arrangement by the housing having a housing lid on the upper side to close the distribution unit tightly and detachably and a housing door on the front through which opening the system reservoir can be removed or replaced with or without the distribution unit.

To insure an adjustment for the differing absorbing quality of the used media to be moistened, a very preferred arrangement distinguishes itself that the volume of the liquid entering the space respectively the liquid mist entering the funnel unit is adjusted by limiting the stroke of the valve unit.

The valve unit can be designed as a double ball valve. This known technology guarantees a reliable functioning over time and an economical use.

A very advantageous arrangement distinguishes itself that an evaporation container is used in which the excessive liquid is directed by way of at least one runoff, and evaporation slots are in the walls of the housing, whereby, an alternative extension is distinguished by the evaporation container having evaporation cascades with especially rough surfaces to increase the evaporation surface.

A preferred arrangement that very simply adjusts the stroke movement regulating the amount of liquid discharged, which is very simple to be designed and constructed, is distinguished by an adjustment unit attached to the housing, especially an adjustment spindle, that is positioned directly or indirectly with the pivoted volume strike beam and on the distribution unit a stroke limiter is positioned that strikes the volume strike beam when the set stroke distance is reached. An exterior viewable scale can be integrated in a favourable manner, whereby the display of the scale is directly controlled by the position of the volume strike beam.

In order to securely prevent the distribution unit from wedging upon reaching the preset stroke distance, an favourable arrangement distinguishes itself by having stroke limiters on both sides of the distribution unit, and having strike curves on both sides of the volume strike beam.

In another embodiment of the present invention, the distribution unit and the housing can be formed separately and of plastic injected molded parts.

Further versions and advantages of the invention result from the characteristics described in the claims, as well as in the following version examples. The characteristics of the claims can be combined at will, inasmuch as they do not obviously rule out each other.

BRIEF DESCRIPTION OF THE DRAWINGS

The invention and its favourable versions and extensions are described and explained in the following according to the examples portrayed in the drawings. The characteristics taken from the description and the drawings can be used individually or in any combination according to the invention. In the drawings:

FIG. 4*a* is a vertical sectional plan view through the device for moistening with an inserted system reservoir distribution unit and stroke adjustment unit, FIG. 4*b* is a horizontal sectional plan view through the device of FIG. 4*a* with a partial section of moistening screen and distribution plate.

DETAILED DESCRIPTION OF THE INVENTION

Figure 5:
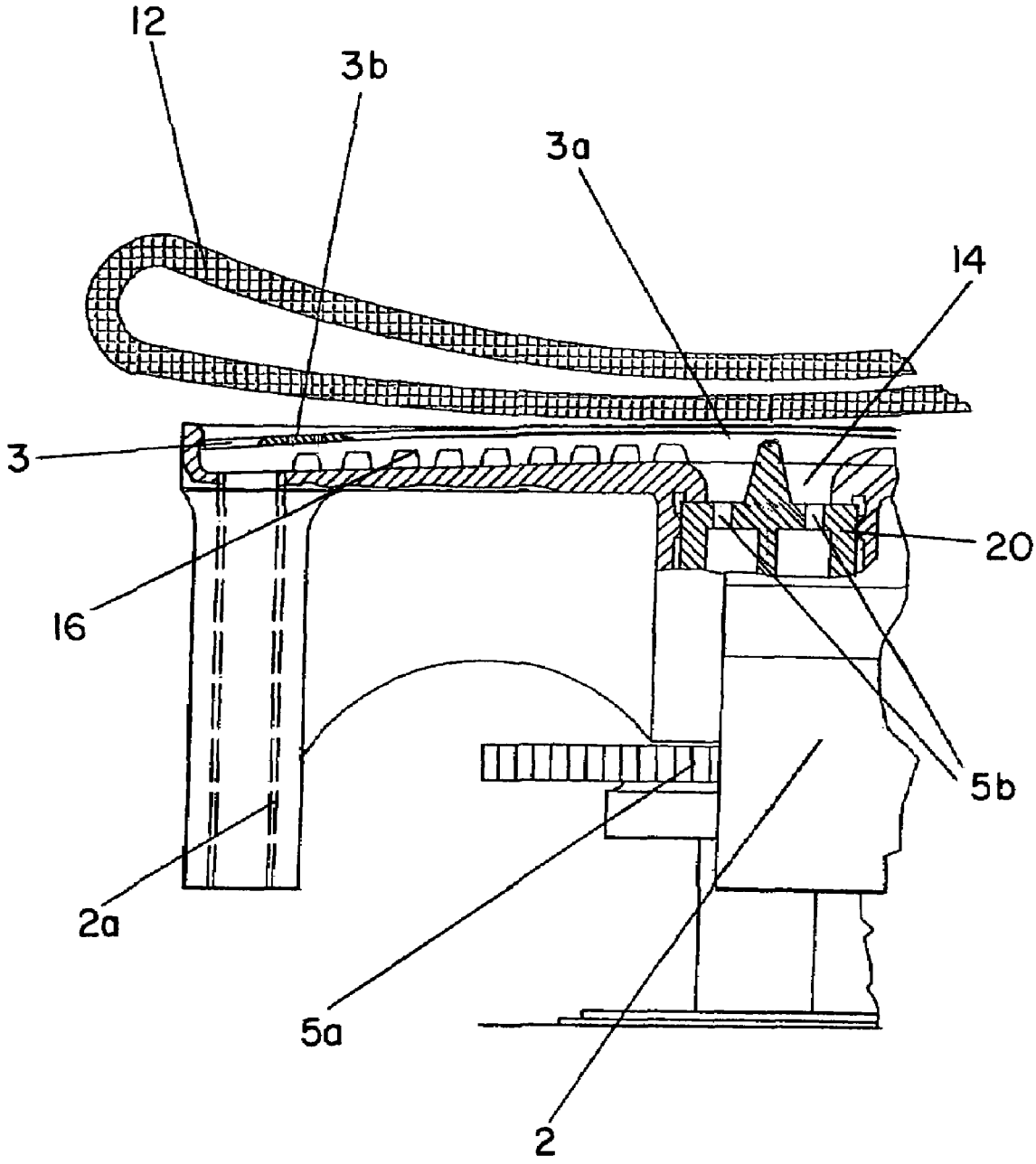
FIG. 5 is an enlarged detail sectional view of the distribution unit set on the valve unit with toilet paper on it.

The following is the description of an example of a device 50 (FIG. 4*a*) for moistening fluid-absorbing media, namely toilet paper 12 (FIG. 5).

Figure 3A:
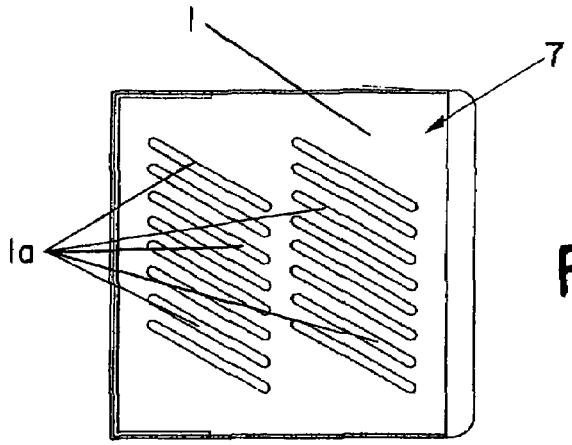
FIG. 3*a* is a top view of the housing of a device for moistening fluid-absorbing media.
Figure 3B:
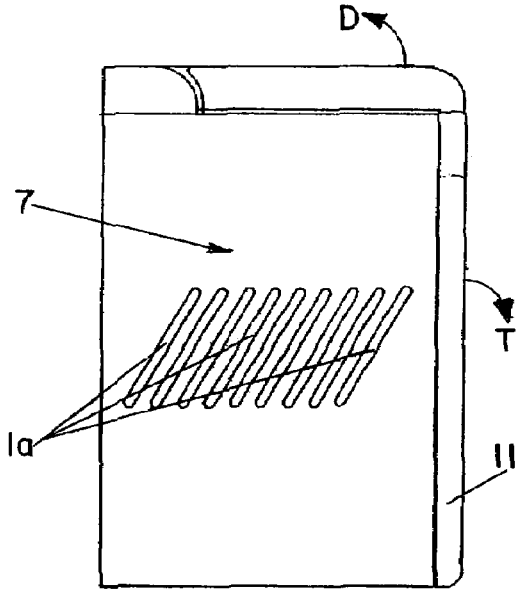
FIG. 3*b* is a side view of the housing of the device of FIG. 3*a*.
Figure 3C:
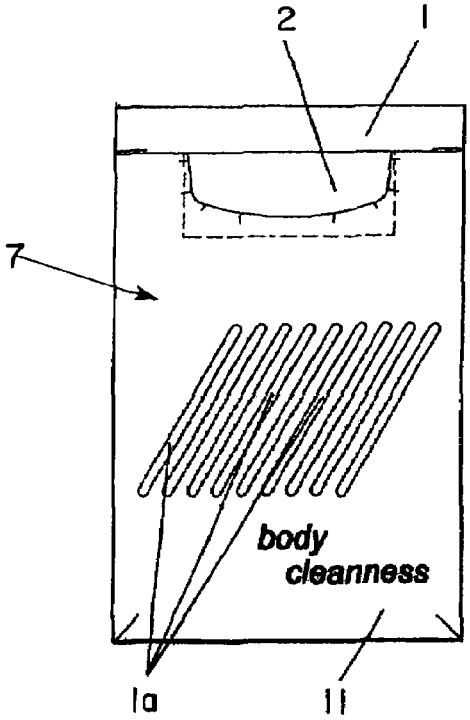
FIG. 3*c* is a front view of the housing of the device of FIG. 3*a*.

The device 50 has a housing 7 with a topside swinging housing lid 1 and a front side swinging housing door 11. All together, the housing 7 has a rectangular outline. On the topside, front side and the side walls there are evaporation slots 1*a* formed in the housing 7 (FIGS. 3*a*–3*c*).

Figure 1:
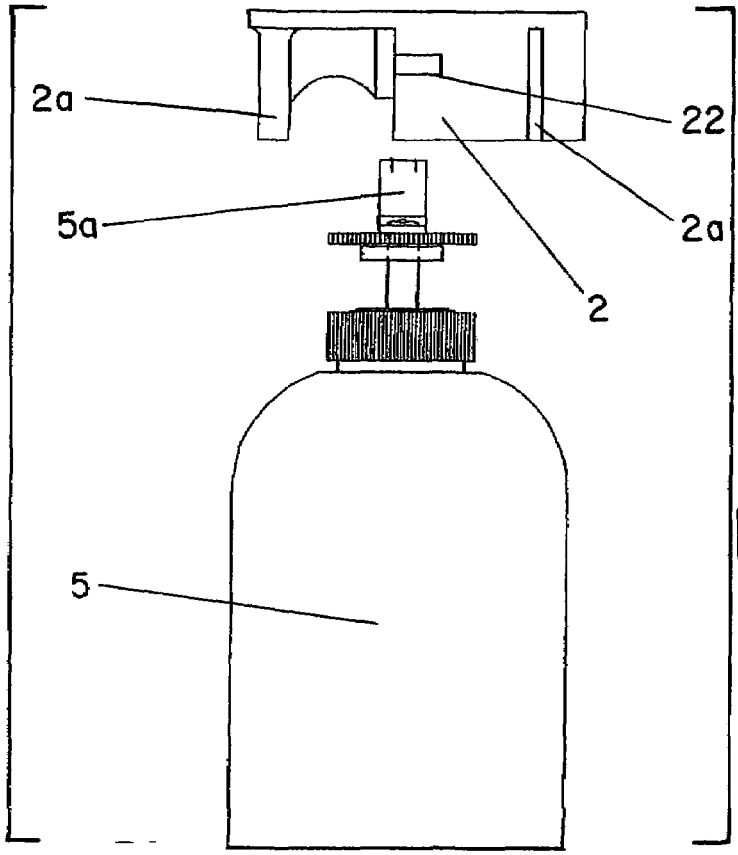
FIG. 1 is a side view of the system reservoir with a separate distribution unit.
Figure 2:
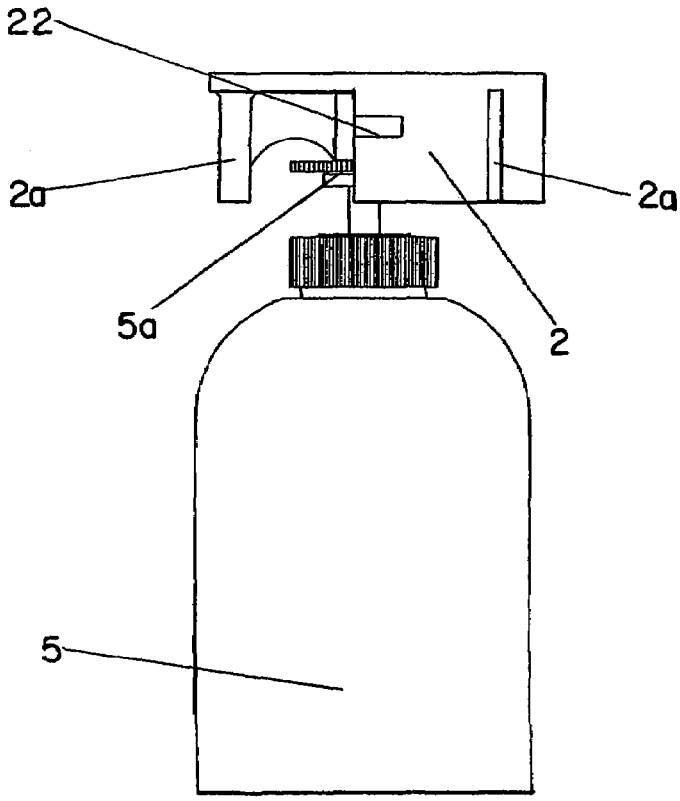
FIG. 2 is a side view of the system reservoir with an attached distribution unit.

Within the housing 7 there is a detachable system reservoir 5 (FIG. 4*a*) of cleansing liquid with a valve unit 5*a* on the topside, which unit is executed as a double ball valve. A detachable distribution unit 2 is connected to the valve unit 5*a* (see FIGS. 1 and 2), in that it is simply set on the valve unit 5*a* and locked.

Figure 6:
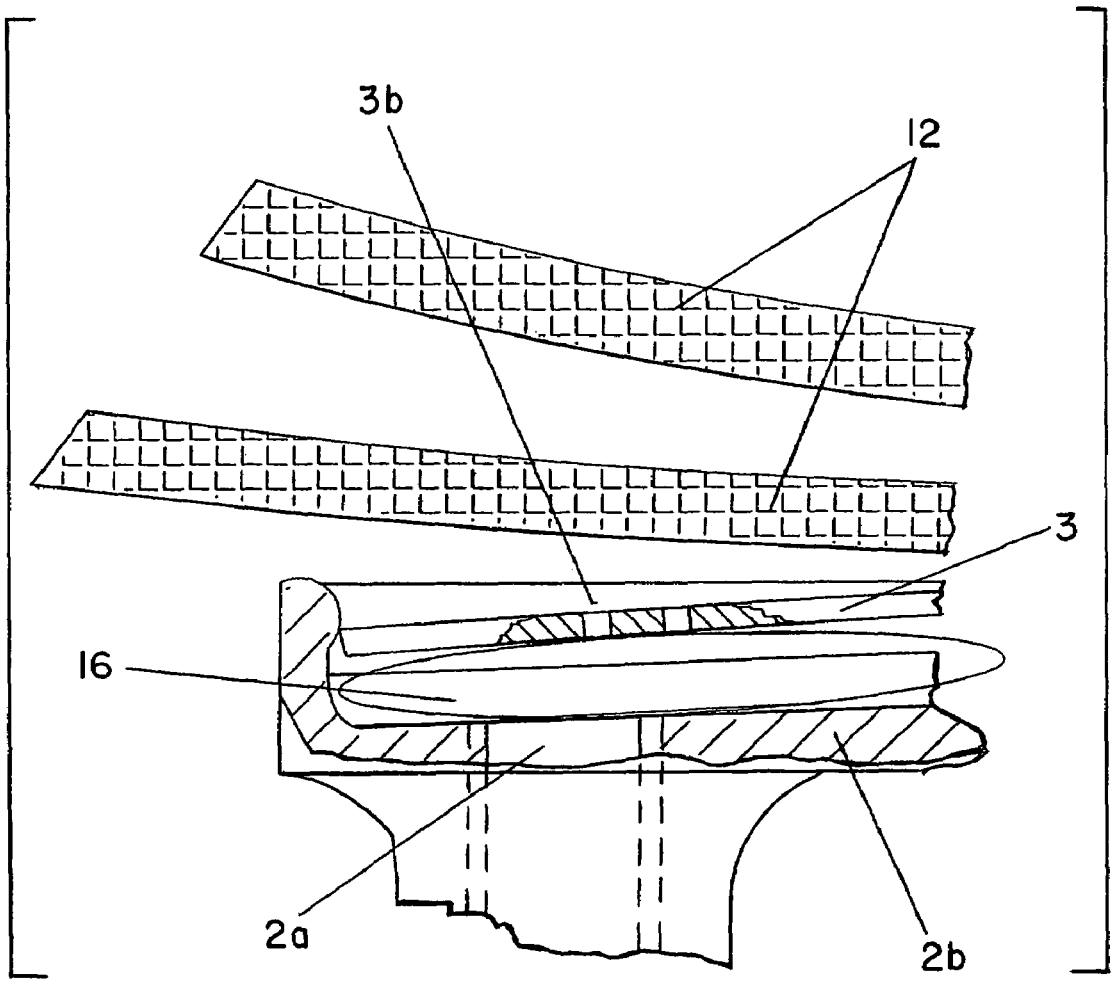
FIG. 6 is an enlarged detail sectional view through the distribution unit in the edge area.
Figure 7:
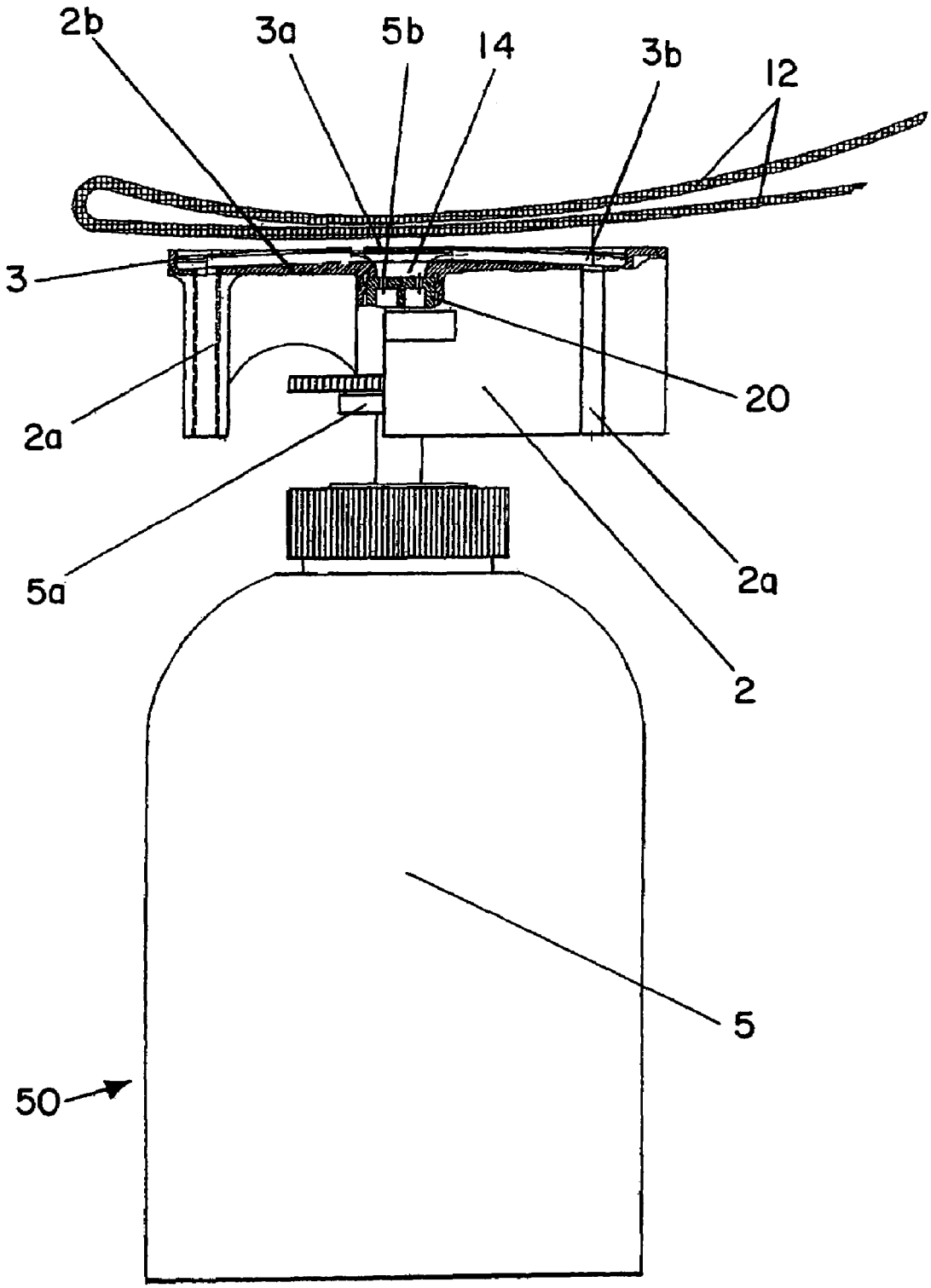
FIG. 7 is a side view of a device for moistening without a housing with a system reservoir, and an attached distribution unit and toilet paper on it.

As shown in FIG. 7 the distribution unit 2 has a distribution plate 2*b* in its upper area, upon the topside of which there is a moistening screen 3 at a distance therefrom with screened through holes 3*b* (FIG. 6) that produce capillary effects. On the bottom side of the distribution plate 2*b* runoffs 2*a* are formed. The toilet paper 12 to be moistened is laid on the upper surface of the moistening screen 3. The distribution plate 2*b* has a recess 14 at its centre, in which the nozzle 20 of the valve unit 5*a* with its exiting surface 5*b* is positioned. Across from the nozzle 20 a rebounding surface 3*a* is located on the bottom of the moistening screen 3.

The space between the distribution plate 2*b* and the moistening screen 3 is shown in FIGS. 5 and 6 with the number 16.

The maximum stroke of the valve unit 5*a* and the connected distribution unit 2 is limited by the pivoted volume strike beam 4 attached at the swivel axis 18 (FIG. 4*a*), whose position is set by the movable connecting link 10 by way of the adjustment unit 9, formed as an adjustment spindle. The volume strike beam 4 has a strike curve 4*a* on top, that hits the stroke limiter 22 on the distribution unit 2 to limit the stroke. For stabilization reasons there are stroke limiters 22 on both sides of the distribution unit 2, and there are strike curves 4*a* on both sides of the volume strike beam 4. A display lever 24 is connected to the volume strike beam 4, that corresponds with the position of the strike beam 4, and with the scale 4*b* that can be seen from above. On the scale 4*b*, orientation numbers can be read for the amount of liquid expelled through one stroke, as set through the adjustment unit 9.

An evaporation container 6 is positioned around the system reservoir 5, in the view from above(FIG. 4*b*)seen as a U-form, such that the open side of the U faces the housing door 11, so that when the housing door 11 is open, the system reservoir 5 can be easily removed. In the bottom area of the evaporation container 6 is the actual collection basin 6*a* which has evaporation cascades 6*b* positioned upwards, leading up to the sloping surface 6*c* that encircles the upper area of the system reservoir 5 with the U-form.

The operation of the device 50, according to an embodiment of the present invention, will now be described.

After pre-cleansing from stool with dry toilet paper, the device 50 offers a comfortable and hygienically sound possibility to moisten the toilet paper with one hand for the final cleaning, whereby the amount of dispensed liquid is preset once on the device according to the quality and structure of the toilet paper.

Already holding the toilet paper 12 in the hand, the user tips the housing lid 1 upward, after which the lid opens itself (arrow D), which then frees the distribution plate 2*b* and the moistening screen 3 for the moistening of the toilet paper 12 (FIG. 4*a*).

If the toilet paper is pressed on the moistening screen 3 the distribution plate 2*b* with the moistening screen 3 moves down until reaching the stroke limiters of the volume strike beam 4. This movement results in a volume reduction in the chamber of the double ball valve 5*a*—part of the system reservoir 5—after which the already sucked in liquid is ejected over the exiting surface 5*b* of the double ball valve 5*a*—(FIG. 4*b*).

The ejected amount of cleansing liquid is pressed against the rebounding surface 3*a* of the moistening screen 3 and distributed in the space 16 between the distribution plate and the moistening screen (FIG. 6).

Through the contact between the moistening screen 3 and the toilet paper 12 the cleaning liquid is transferred from the above mentioned space by a "blotting-paper" effect. The many small holes 3*b* in the moistening screen 3 are dimensioned so as to have a capillary effect, however, being positioned within the screen so that during the moistening process, an "over wetting" cannot happen, even if the volume of liquid was preset too high for the used paper. Excessive liquid flows into the evaporation container 6.

A fundamental part of the invention lies in the positioning of the distribution plate 2*b* and the moistening screen 3 in relation to each other, as well as their dimensions in order to achieve the "blotting-paper" effect. Comparable example: If a fountain pen(ink) is placed on a piece of blotting paper, the transfer of ink to the paper begins very quickly due to the capillary effect of the paper. The transfer of ink to the paper then becomes slower and slower as less ink flows from the opening in the pen to the paper, since ink can only flow into the structure of the paper as the ink already in the paper flows further into the structure of the paper.

Since not all types of toilet paper 12 have the same flow characteristics for quick and proportioned absorption of the cleansing liquid, it is necessary to have a device in which the amount of expelled liquid is preset so that a favourable relation—toilet paper absorption capability to volume release and transfer through the moistening screen—is adjusted.

When the moistening screen 3 is let go after the toilet paper has absorbed the liquid, the distribution plate 2*b* and the moistening screen 3 return to their original position through the spring tension in the double ball valve 5*a*. During this process the appropriate amount of cleansing liquid is sucked into the valve 5*a* and is separated from the environment by a ball (not shown).

The lid 1 of the housing 7 is then closed after which the moistening screen 3 is protected.

Small remaining amounts of cleansing liquid flow over the runoffs 2*a* of the distribution plate 2*b* and drop into the evaporation container 6 there under. The evaporation container 6 is equipped with cascades 6*b* with a relatively rough surface to evaporate the remaining liquid. Due to the surface tension of the liquid, the liquid flows longer distances before reaching the collecting basin 6*a* of the evaporation container 6, evaporating in the process. Large air slot openings 1*a* for the convection of air are in the front and sides of the housing 7, in the housing lid 1 and in the intermediate floor 8, so that a chimney effect results throughout the entire housing 7. This effect not only evaporates the remaining excessive cleansing liquid, freshening the air in the room, but also ensures that even small dust particles that could enter the device through the small openings in the housing lid, do not settle on the moistening screen 3.

Accordingly, this effect can be supported by using cleansing liquids that are perfumed and mixed with small amounts of alcohol which is common in such cleansing liquids. The expelling of perfume can be increased by adding substances to the evaporation container 6. Using this method the secondary function as air freshener in the rest room is in effect.

The device 50 completes the task of moistening normal toilet paper, while satisfies hygiene standards, using a cleansing liquid from an exchangeable closed refill system reservoir, on a defined area with a preset volume.

Once the cleansing liquid is all used, then the system reservoir 5 with valve unit 5*a* is easily removed from the device (arrow A in FIG. 4*a*), by opening the housing door 11 (arrow T), removing the empty system reservoir and replacing it with a full container available on the market.

Hygiene conditions are largely satisfied, if the user has to tear off a seal from the nozzle opening on the valve head of the valve unit 5*a*, before placing the system reservoir 5 with cleansing liquid into the housing 7—as is familiar from toothpaste—and then setting the distribution unit 2 onto the reservoir unit. The valve head of the valve unit 5*a* on the system reservoir 5 is secured/locked against the environment during transport, making an unwanted pump stroke and accompanying liquid spillage impossible.

The safety catch is loosened by turning the valve unit 5*a* and the attached distribution unit 2 by way of a threading and the group—valve unit 5*a*, distribution plate 2*b* and the moistening screen 3—are pushed upward against the internal valve stop into the functioning position. A dispensing pumping is then possible. This insures that the user does not come in contact with the cleansing liquid before the actual cleansing process (stool).—This principle is known from hand washing lotion.—

Furthermore, the cleansing liquid is protected from the environment after placement in the device through the double ball valve 5*a*.

The cleansing liquid is dispensed from the system reservoir 5 by pressing down the unit distribution plate 2*b* with moistening screen 3—a sponge or mesh unit could be conceivable. The cleansing liquid in a predetermined amount is then absorbed by the toilet paper through contact between the moistening screen 3 and the toilet paper 12.

In order to accommodate the different toilet paper types and structures, the device has a volume adjuster. By turning the adjustment spindle 9 the strike position of the volume strike beam 4 is adjusted by way of the connecting link 10. The stroke of the distribution plate 2*b* is limited by the strike curve 4*a* of the volume strike beam 4.

The dispensed volume of the cleansing liquid is determined by the stroke of the distribution plate 2*b* that moves up to the volume strike beam 4. The stroke height of the distribution plate 2*b* is transferred to the valve unit 5*a* of the system reservoir 5 and is equal to the amount of dispensed liquid volume.

Figure 8A:
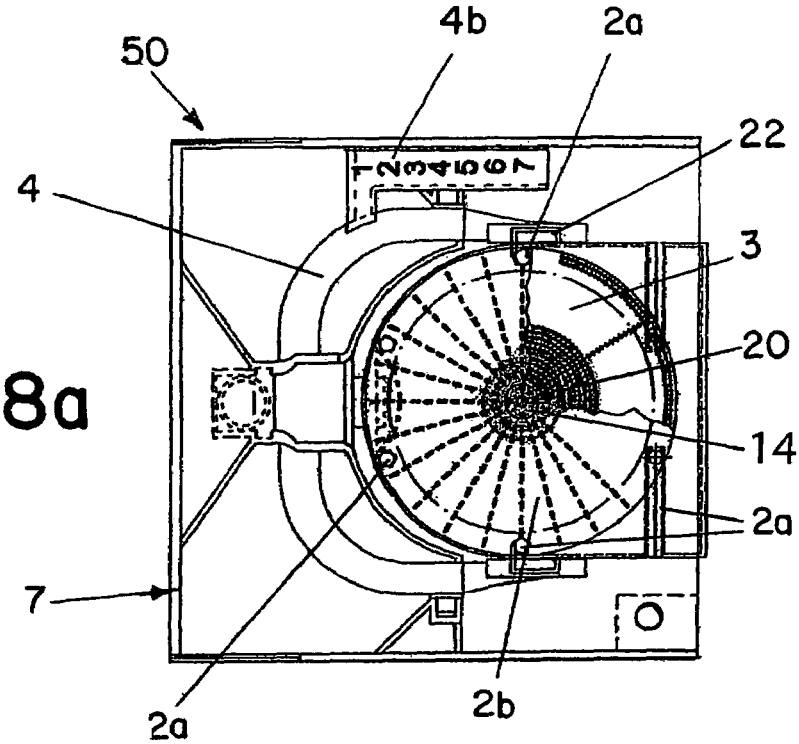
FIG. 8*a* is a top view of the device of FIG. 4*a* without the top part.
Figure 8B:
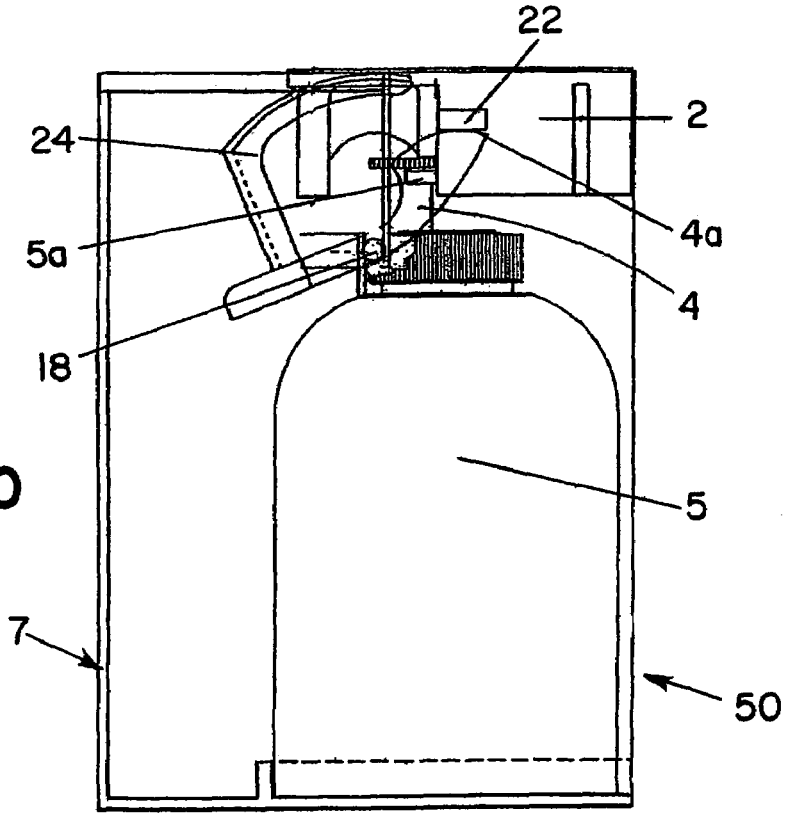
FIG. 8*b* is a side view of the device of FIG. 8*a*.

The volume strike beam 4 has a side part that has a scale 4*b* (FIG. 8*a*). This is designed so that the scale swivels under a viewing window in the intermediate housing flooring 8, as the adjustment spindle 9 is turned which then changes the strike position 4*a* of the volume strike beam 4. The shown numbers are representative of the dispensed doses of cleansing liquid, or serves as the setting for different toilet paper types.

The contact surface for the liquid transfer on the moistening screen 3 is covered by the housing lid 1 when not in use, and is in the airflow within the housing 7 so that it will not get dirty under normal circumstances.

The back of the housing 7 can be designed for wall mounting. On the underside of the housing 7 a system connection fitting can be furnished, so that an alternative attachment with another installed housing below can be made, for example a device in which a toilet paper roll is mounted and dispensed, and other utensils are found.

Figure 9:
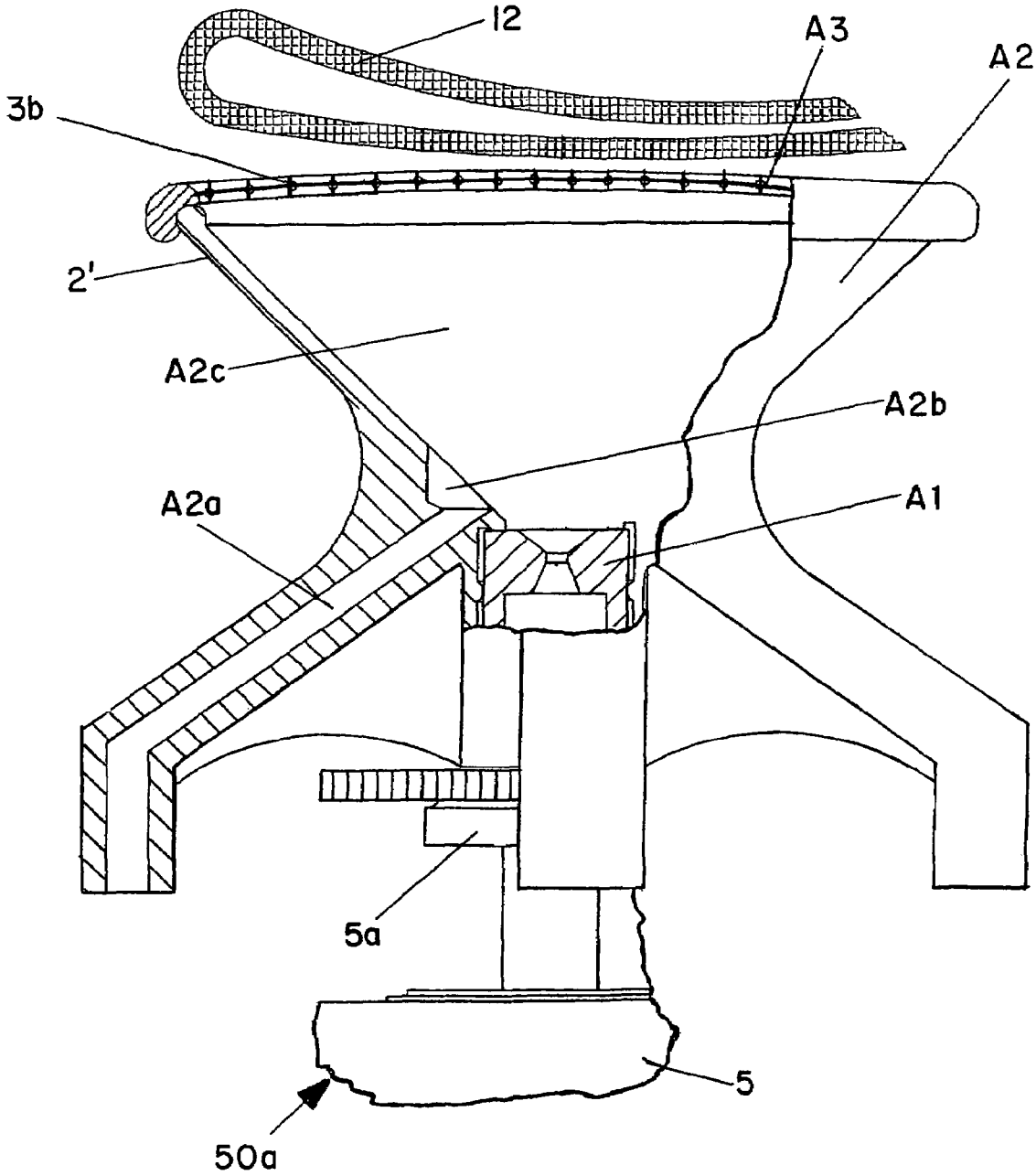
FIG. 9 is an enlarged detailed sectional side view of a distribution unit in funnel form for a device for moistening, shown without housing, according to another embodiment of the present invention.
Figure 10:
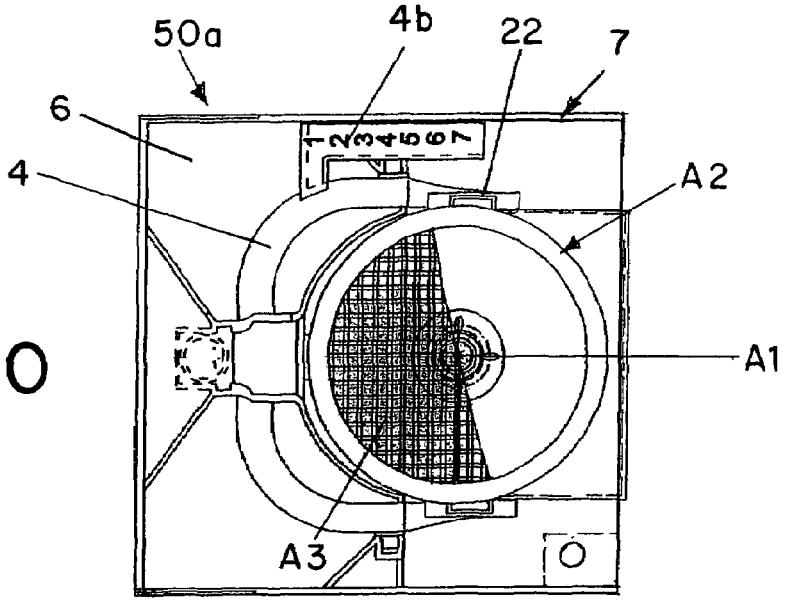
FIG. 10 is a top view of the device for moistening with a distribution unit of FIG. 9 inserted in the system reservoir.
Figure 11:
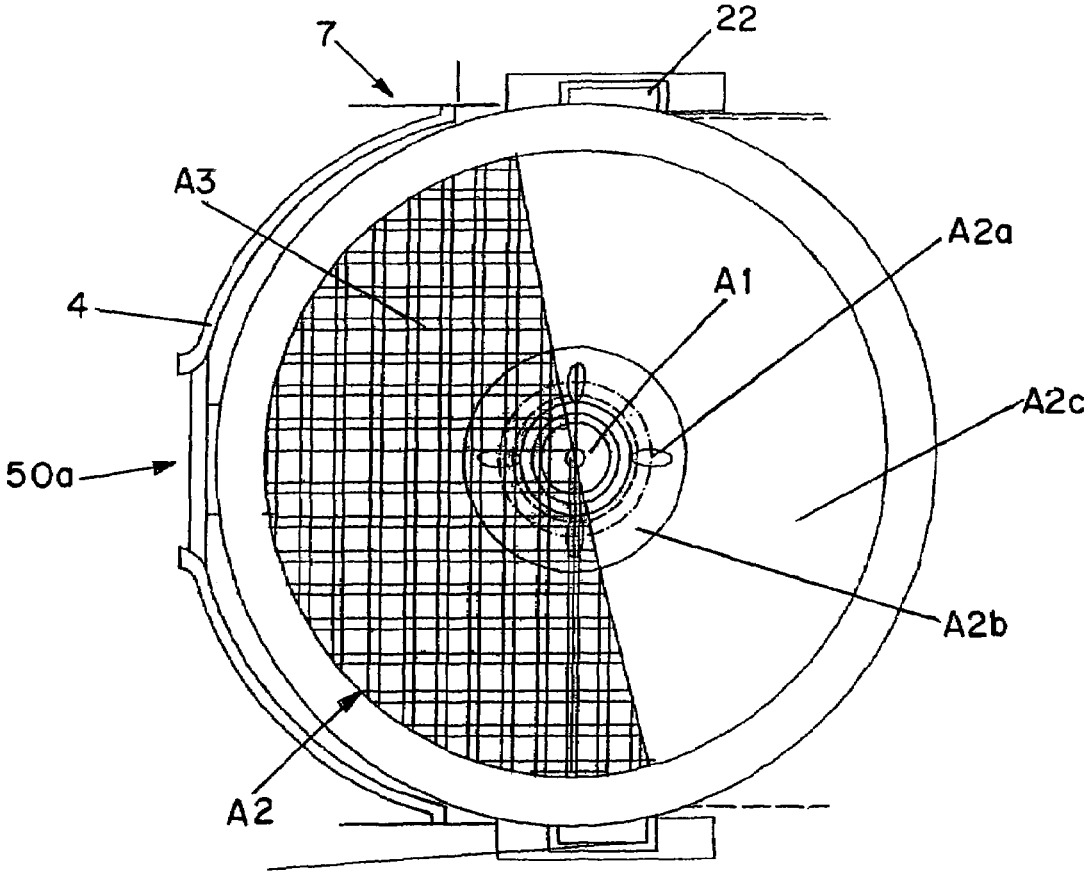
FIG. 11 is a top view of the device of FIG. 10 with an enlarged distribution unit.

In FIGS. 9 to 11 another version of the device 50*a* is shown, that functions on the same fundamental principle as the device example shown above. However, in this version, as seen in FIGS. 9 to 11, a distribution unit 2' is used that has a funnel unit A2, whereby, a moistening mesh A3 is placed on the end of the funnel with the large diameter, which mesh has through holes 3*b* in it that are so dimensioned as to insure a capillary effect.

In the floor area of the funnel unit A2, which is the area of the small diameter of the funnel unit A2, a nozzle A1 is positioned, which is connected to the system reservoir 5. The entire distribution unit 2' is detachably positioned on the valve unit 5*a* of the system reservoir 5. However, contrary to nozzle 20 of the device 50, the nozzle A1 is designed as a spraying nozzle, which means that the liquid is not ejected as a jet stream, but rather as a liquid mist, that when sprayed into the interior chamber of the funnel unit A2 which is limited by the side surfaces of the funnel A2*c*, it is deposited on the moistening mesh A3 so that when toilet paper 12 is laid on it, the paper absorbs the liquid due to the capillary effect.

Also by pressing the distribution unit 2' down the liquid in form of liquid mist is brought into the funnel unit A2 and directed to the moistening mesh A3.

The liquid not absorbed by the toilet paper 12, and the liquid that during the spraying process settles on the funnel surfaces A2*c* of the funnel unit A2, gathers in a return flow channel A2*b*, and directed to the runoffs A2*a* located on the circumference at 90° (old degrees) positions.

The runoffs A2*a* lead the excessive liquid to the evaporation container 6 that has already been described above. All other parts carry the same numbers as in the first execution example and are not repeated here. Also in this solution (version), it is possible to regulate the amount of liquid mist entering the funnel unit A2, or to adjust the vertical stroke of the distribution unit 2', dependant upon the absorbing qualities of the used toilet paper 12.

The described devices 50 and 50*a* optimally solve the moistening problem, after they have been mounted to the wall, well in reach in the sanitary area, and transfer the liquid to the media in the above described manner. With this, the device fulfills criteria such as safety, optic, function, and time reduction and satisfies high demands.

I claim:

1. A device for moistening a fluid absorbing media for body-hygiene or care comprising:

a housing, a system reservoir removably located in the housing and storing a fluid for moistening the media, and a stroke valve unit attached to the system reservoir and dispensing a liquid or a liquid mist through a nozzle, a distribution unit removably located in the housing and having a distribution plate, the distribution plate includes a recess at a center of the distribution plant in which the nozzle is positioned, wherein a movement of the distribution unit causes a stroke movement of the stroke valve unit, and a capillary unit attached to the distribution unit and receives the fluid-absorbing media wherein pressing the media on the capillary unit and pressing the capillary unit initiates the stroke movement of the stroke valve unit wherein the liquid or the liquid mist released through the stroke movement of the stroke valve unit is at least partially taken up through a capillary effect into the capillary unit, and the liquid or the liquid mist is passed to the fluid-absorbing media via a capillary effect, wherein:

the housing comprises:

a topside housing lid to temporarily close the distribution unit, and a front side housing door, and wherein the system reservoir can be placed into and removed from the housing through an opening formed by the front side housing door.

2. A device for moistening a fluid-absorbing media for body-hygiene or care comprising:

a housing, a system reservoir removably located in the housing and storing a fluid for moistening the media, and a stroke valve unit attached to the system reservoir, the stroke valve unit giving off a liquid or a liquid mist by a nozzle, a distribution unit removably located in the housing and having a distribution plate including a recess at a center of the distribution plate in which the nozzle is positioned, such that movement of the distribution unit causes a stroke movement of the stroke valve unit, a capillary unit attached to the distribution unit and receives the fluid-absorbing media such that pressing the media on the capillary unit and pressing the capillary unit initiates the stroke movement of the valve unit wherein the liquid or the liquid mist released through the stroke movement of the stroke valve unit is at least partially taken up through a capillary effect into the capillary unit, and the liquid or the liquid mist is passed to the fluid-absorbing media via a capillary effect, at least one runoff provided on the distribution unit, and an evaporation container wherein evaporation slots are formed in walls of the housing.

3. The device according to claim 2, wherein the evaporation container has evaporation cascades with rough surfaces that increase an evaporation surface.

4. A device for moistening a fluid-absorbing media for body-hygiene or care comprising:

a housing, a system reservoir removably located in the housing and storing a fluid for moistening the media, and a stroke valve unit attached to the system reservoir, the stroke valve unit dispensing a liquid or a liquid mist by a nozzle, a distribution unit removably located in the housing and having a distribution plate, the distribution plate includes a recess at a center of the distribution plate in which the nozzle is positioned, wherein a movement of the distribution unit causes a stroke movement of the stroke valve unit, and a capillary unit attached to the distribution unit and receives the fluid-absorbing media such that pressing the media on the capillary unit and pressing the capillary unit initiates the stroke movement of the stroke valve unit wherein the liquid or the liquid mist released through the stroke movement of the valve unit is at least partially taken up through a capillary effect into the capillary unit, and the liquid or the liquid mist is passed to the fluid-absorbing media via a capillary effect, an adjustment unit attached to the housing and positioned with a pivotable volume strike beam, and a stroke limiter positioned on the distribution unit, wherein:

the stroke limiter strikes the volume strike beam when a set stroke distance is reached.

5. The device according to claim 4, further comprising an exterior viewable scale having numbers representing a dispended dose of liquid wherein the display of the scale is directly controlled by the position of the volume strike beam.

6. The device according to claim 4, further comprising stroke limiters on both sides of the distribution unit, and strike curves on both sides of the volume strike beam.

7. A device for moistening a fluid-absorbing media for body-hygiene or care comprising:

a housing, a system reservoir removably located in the housing and storing a fluid for moistening the media, and a stroke valve unit attached to the system reservoir, the valve unit giving off a liquid or a liquid mist by a nozzle, a distribution unit removably located in the housing and having a distribution plate, the distribution plate includes a recess at a center of the distribution plate in which the nozzle is positioned, such that movement of the distribution unit causes a stroke movement of the stroke valve unit, a capillary unit attached to the distribution unit and receives the fluid-absorbing media such that pressing the media on the capillary unit and pressing the capillary unit initiates the stroke movement of the stroke valve unit such that the liquid or the liquid mist released through the stroke movement of the valve unit is at least partially taken up through a capillary effect into the capillary unit, and the liquid or the liquid mist is passed to the fluid-absorbing media via a capillary effect, wherein the distribution unit comprises at least one runoff, an evaporation container positioned around the system reservoir in a U-form, wherein the open side of the U-form faces a door of the housing.

8. The device according to claim 7, wherein the distribution unit further comprises a funnel unit.

9. The device according to claim 2, wherein the distribution unit further comprises a funnel unit.

* * * * *